United States Patent [19]

Berkbigler

[11] 4,177,225

[45] Dec. 4, 1979

[54] FUEL METERING ROD POSITION CONTROL

[76] Inventor: Kenneth A. Berkbigler, 1710 Vandover Rd., Fenton, Mo. 63026

[21] Appl. No.: 914,374

[22] Filed: Jun. 12, 1978

[51] Int. Cl.[2] ..... F02M 7/22

[52] U.S. Cl. ..... 261/50 A; 261/51

[58] Field of Search ..... 261/50 A, 51

[56] References Cited

U.S. PATENT DOCUMENTS

| | | | |
|---|---|---|---|
| 1,838,421 | 12/1931 | Linkert | 261/50 A |
| 2,098,202 | 11/1937 | Weber | 261/50 A |
| 2,457,570 | 12/1948 | Leibing | 261/50 A |
| 3,278,171 | 10/1966 | Carlson | 261/50 A |
| 3,278,173 | 10/1966 | Cook et al. | 261/50 A |
| 3,284,062 | 11/1966 | Obermeyer, Jr. | 261/50 A |
| 3,307,837 | 3/1967 | Winkler | 261/50 A |
| 3,309,069 | 3/1967 | Braun et al. | 261/50 A |

*Primary Examiner*—Tim R. Miles

[57] ABSTRACT

A carburetor comprises a carburetor body having an induction passage, a throttle valve positioned in the passage, a fuel circuit through which fuel is drawn from a fuel bowl for mixing with air to form an air-fuel mixture, a fuel metering rod responsive to movement of the throttle valve for varying the quantity of fuel flowing through the fuel circuit, and a staging valve positioned in the induction passage and movable between an open and a closed position, the staging valve functioning as a choke valve during engine cranking and warm-up and as an air valve during other engine operating conditions. The fuel metering rod is positioned relative to an inlet to the fuel circuit in response to opening and closing movements of the staging valve, when it functions as an air valve, to control the quantity of fuel flowing through the fuel circuit as demand for air by the engine increases or decreases. This control of the fuel metering rod is independent of the control thereof by the throttle valve.

4 Claims, 5 Drawing Figures

FUEL METERING ROD POSITION CONTROL

BACKGROUND OF THE INVENTION

This invention relates to fuel flow control in a carburetor and, more particularly, to controlling the position of a fuel metering rod which is conventionally controlled by movement of a throttle valve of the carburetor.

In application Ser. Nos. 914,308; 914,309; 914,314; and 914,324 all filed June 12, 1978,
each of which is assigned to the same assignee as this application, a staged single barrel carburetor is disclosed which is useful on smaller internal combustion automobile engines such as 4 and 6 cylinder engines. The carburetor described is advantageous in that it promotes fuel economy and reduced engine emissions together with good driveability. An important aspect of this carburetor is the use of a staging valve which functions as a choke valve during engine cranking and warm-up and as an air valve during other engine operating conditions. It is desirable that during operation of the staging valve as an air valve that the fuel metering rod controlling the flow of fuel through the carburetor's fuel circuit move in response to the opening and closing movement of the staging valve. This permits more or less fuel to be drawn to the carburetor's induction passage for mixing with air being drawn into the engine.

SUMMARY OF THE INVENTION

Among the several objects of the present invention may be noted the provision of a staged, single-barrel carburetor having a fuel circuit and fuel metering rod movable relative to an inlet to the fuel circuit and a staging valve which, at times, functions as an air valve; the provision of such a carburetor having means for controlling the position of the fuel metering rod relative to the fuel circuit inlet when the staging valve is functioning as an air valve; and the provision of such a carburetor in which the aforesaid means functions independently of the operation of a throttle valve of the carburetor to control the position of the fuel metering rod.

Briefly, the present invention is an improvement for a carburetor for an internal combustion engine, the carburetor comprising a carburetor body having an induction passage through which air is drawn into the engine, a throttle valve positioned in the passage and movable between an open and a closed position to control the quantity of air drawn into the engine, a fuel circuit through which fuel is drawn from a fuel bowl to the induction passage for mixing with air to form an air-fuel mixture combusted in the engine, a fuel metering rod responsive to movement of the throttle valve for varying the quantity of fuel flowing from the fuel bowl through the fuel circuit, and a staging valve positioned in the induction passage and movable between an open and a closed position, the staging valve functioning as a choke valve during engine cranking and warm-up and as an air valve during other engine operating conditions. The improvement comprises means responsive to opening and closing movements of the staging valve when it functions as an air valve for positioning the fuel metering rod relative to an inlet to the fuel circuit to control the quantity of fuel flowing through the fuel circuit as demand for air by the engine increases or decreases. The control means operates independently of the throttle valve to control the quantity of fuel flow.

Other objects and features will be in part apparent and in part pointed out hereinafter.

DESCRIPTION OF A PREFERRED EMBODIMENT

Figure 1:
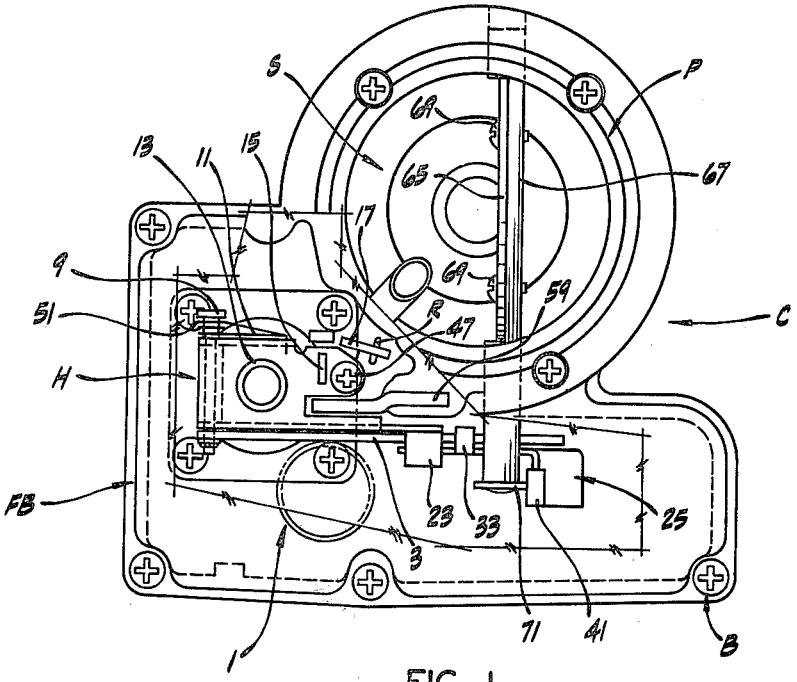
FIG. 1 is a top plan view of a portion of a carburetor illustrating control means of the present invention.
Figure 2:
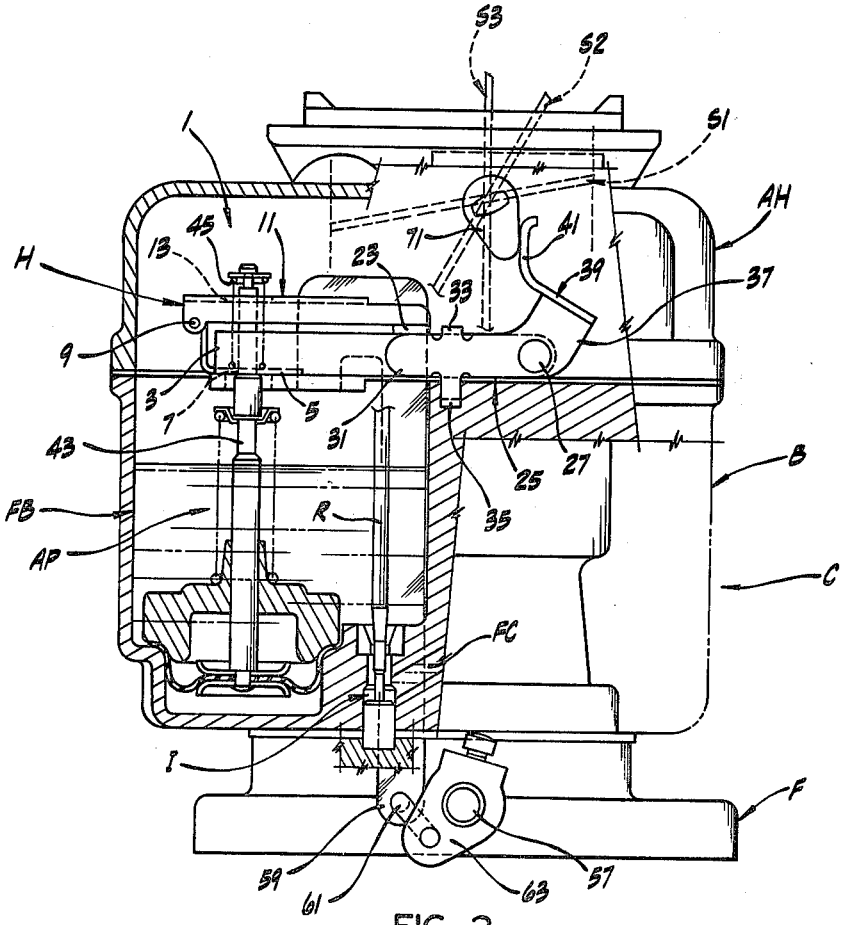
FIG. 2 is a side elevational view of the carburetor, partly in section, further illustrating the control means of the present invention.

Referring to the drawings, a carburetor for an internal combustion engine (not shown) is indicated generally C and comprises a carburetor body B, an air hornAH and a throttle flange F. The carburetor assembly is shown in FIG. 2. The carburetor body has an induction passage P formed therein through which air is drawn into the engine. Carburetor C has only one such induction passage and is commonly referred to as a single-barrel carburetor. A throttle valve (not shown) is positioned in the lower outlet end of this induction passage and is movable between an open and a closed position to control the quantity of air drawn into the engine. A fuel circuit FC (a portion of which is shown in FIG. 2) provides a path by which fuel is drawn from a fuel bowl FB (formed in carburetor body B) to the induction passage for mixing with air to form an air-fuel mixture combusted in the engine.

A fuel metering rod R is responsive to movement of the throttle valve for varying the quantity of fuel flowing from the fuel bowl through the fuel circuit. As shown in FIG. 2, fuel circuit FC has an inlet I at the bottom of the fuel bowl. The fuel metering rod is vertically disposed in the fuel bowl and the lower end of the rod, which is tapered, is positioned in the inlet.

A staging valve S is positioned in the induction passage, at its upper inlet end, and is movable between an open and a closed position. The staging valve functions as a choke valve during engine cranking and warm-up and an air valve during other engine operating conditions. The mechanism by which staging valve S is permitted to function in this manner is disclosed in copending application Ser. Nos. 914,308; 914,309; 914,314; and 914,324 all filed June 12, 1978, the disclosures of which are incorporated herein by reference. These applications are assigned to the same assignee as the present application. In operation, staging valve S has a closed position (position S1 in FIG. 2) to which it moves during cranking of the engine on which the carburetor is installed. During warm-up of the engine, the staging valve functions as a choke valve and moves from position S1 to position S2. During other engine operation conditions, the staging valve is permitted to function as an air valve and is freely movable between position S2 and its fully open position S3 solely in response to the demand for air by the engine.

An improvement to carburetor C comprises means generally indicated 1 responsive to opening and closing movements of staging valve S, when it is functioning as an air valve, for positioning fuel metering rod R relative to fuel circuit inlet I. This permits control of the quantity of fuel flowing through the fuel circuit as demand for air by the engine increases or decreases. As previously indicated, the fuel metering rod is vertically movable relative to the inlet and control means 1 includes a hangar assembly, generally designated H, for the rod. The hanger assembly includes a lower stationary arm 3 having an inwardly extending plate 5 in which a circular opening 7 is formed. One end of plate 5 extends out beyond arm 3 and this end of the plate projects upwardly. The upper end of the projection is turned over on itself to form a receptacle for a pin 9.

The hangar assembly further includes a rotatable or movable carrier 11 having an inverted U shape. A circular opening 13 is formed in the top of the carrier as is a slot 15. Opening 13 is directly above opening 7 in plate 5. The upright portion of a generally L-shaped bracket 17 fits through slot 15. The bracket has a depending portion 19 in which an opening 21 is formed and the upper end of the fuel metering rod fits through this opening to suspend the rod from the carrier. The downwardly extending leg portions of carrier 11 straddle the upwardly extending portion of plate 5 and openings are formed in the rearward end of each leg so the carrier can be hingedly attached to the plate by pin 9. Further, the forward leg of the carrier is somewhat longer than the rearward leg thereof and a tab 23 projects outwardly from the front side of the forward leg. The carrier has a normal rest position in which carrier 11 is parallel to stationary arm 3 and in this position the under surface of tab 23 rests atop the upper surface of the stationary arm.

A bell crank 25 is pivotally attached to the other end of stationary arm 3 by a pin 27 and a spacer 29. The bell crank is mounted on the front face of stationary arm 3. The bottom surface of tab 23 also rests on top of the upper surface of arm 31. Arm 31 has upper and lower inwardly projecting tangs 33 and 35 respectively. These tangs bracket stationary arm 3 and limit the rotational movement of the bell crank. The bell crank has a second arm 37 extending diagonally upwardly at an obtuse angle from arm 31. A contact plate 39 extends outwardly from the upper end of arm 37 and the plate has a vertical leg 41.

The entire hangar assembly is attached to an acceleration pump AP which is installed in the fuel bowl of the carburetor. Specifically, the acceleration pump has a vertical stem 43 which has a reduced diameter section at its upper end. Opening 7 in plate 5 fits over the stem and plate 5 seats against the shoulder formed by the stem diameter reduction. The upper portion of the stem extends through opening 13 in carrier 11 and because the carrier is rotatable about the hinge formed by pin 9, this opening has a larger diameter than that of opening 7. A coil spring 45 fits over the upper end of stem 43 and seats against the upper surface of plate 5 to maintain the hangar assembly in its proper position on the stem. When so installed, fuel metering rod R is positioned to inlet I to fuel circuit FC. The position of the fuel metering rod relative to the inlet is adjustable by means of an adjustment screw 47 which fits through an opening in the upper surface of carrier 11 and a corresponding opening in the base of bracket 17. The screw is spring-loaded by a spring 49. When installed, carrier 11 has a normal or rest position when, as peviously described, tab 23 rests against the upper surface of stationary arm 3 and arm 31 of bell crank 25. A coil spring 51 fits over pin 9 to bias the carrier toward its rest position. One end of this spring fits in an opening formed in a tab 53 which depends from the inner leg of carrier 11 and the other end of the spring fits in an opening in a tab 55 which projects upwardly from the inner end of plate 5.

The throttle valve in passage P is mounted on a shaft 57 and this shaft is connected to the lower end of a fuel metering rod lifter 59 via a link 61 and a lever 63; this lever being fixedly attached to shaft 57. The upper end of lifter 59 fits about stem 43 of acceleration pump AP at a point immediately below the point where hangar assembly H fits on the stem and the lifter is raised and lowered in response to opening and closing of the throttle valve, all as is well known in the art. Raising and lowering of the hangar assembly raises and lowers the tapered end of fuel metering rod R with respect to the fuel circuit inlet, again as is well known in the art.

Staging valve S comprises a disk 65 mounted on a rotatable shaft 67 by screws 69. Control means 1 includes a cam 71 fixedly mounted on the outer end of shaft 67. Leg 41 of contact plate 39 contacts cam 71 when staging valve S is functioning as an air valve.

Figures 3, 4, 5:
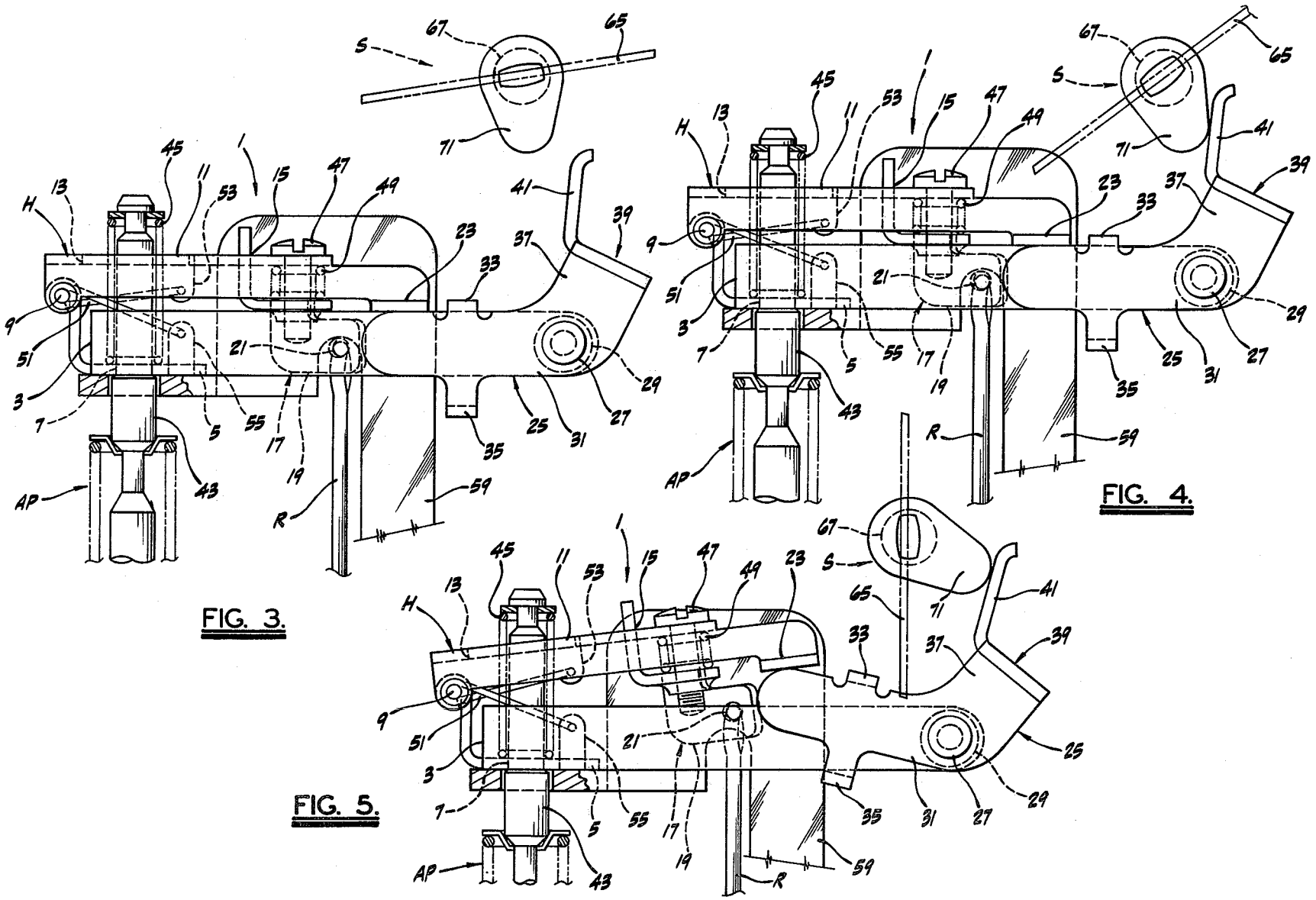
FIGS. 3–5 are side elevational views of the control means illustrating its operation to control the position of a fuel metering rod of the carburetor when a staging valve thereof functions as an air valve. Corresponding reference characters indicate corresponding parts throughout the several views of the drawings.

Referring to FIGS. 3–5, FIG. 3 illustrates the situation when staging valve S is at the position S1 indicated in FIG. 2. This is the staging valve position for cranking of the engine and for this starting condition the throttle valve is closed. At this time, hangar assembly H is sufficiently below the level of staging valve S so cam 71 is out of contact with contact plate 39.

FIG. 4 represents the situation corresponding to position S2 of the staging valve. This position is reached when the staging valve, acting as a choke valve, has opened up in response to engine warm-up. As described in the above-referenced copending applications, staging valve S is prevented from further opening past the S2 position until the throttle valve opens past a predetermined position. Opening of the throttle valve raises lifter 59 which, in turn, raises hangar assembly H in the manner well known in the art, that is the link 61, lever 63 arrangement raises the lifter and the lifter, in turn, raises the hangar assembly. Raising of the hangar brings contact plate 39 into contact with cam 71, as shown in FIG. 4, but because the staging valve is not yet functioning as an air valve, the cam does not produce rotation of the bell crank and carrier 11 remains at rest.

Once the throttle valve opens past its predetermined position, staging valve S functions as an air valve and is freely movable between its position S2 (a partially open position) and its position S3 (its fully open position). The movement of the staging valve between these two positions is solely in response to increasing or decreasing demand for air by the engine. The fully open position of the staging valve is shown in FIG. 5. As staging valve S moves toward its fully open position in response to an increased demand for air by the engine, shaft 67 rotates counterclockwise and cam 71 bears against leg 41 of contact plate 39 and bell crank 25 is rotated in a clockwise direction. Arm 31 of the bell crank bears against tab 23 to rotate carrier 11 in a counterclockwise direction about hinge pin 9. This action raises the carrier and the fuel metering rod is moved (i.e. raised) relative to the fuel circuit inlet. This results in a smaller diameter end portion of the fuel metering rod being positioned in the inlet so flow of fuel through the fuel circuit increases. If there is a decreasing demand for air by the engine, the staging valve moves toward its S2 position and the carrier is urged toward its rest position by spring 51. This lowers the fuel metering rod relative to the fuel circuit inlet and produces a decrease in fuel flow through the fuel circuit.

It will be understood that as the throttle valve continues to move toward its fully open position, the hangar assembly will be raised and that this too raises the fuel metering rod relative to the fuel circuit inlet. However, the staging valve, when functioning as an air valve, operates independently of the throttle valve. That is, if the throttle valve were stationary and there was an increase or decrease in the demand for air by the engine, the resulting opening or closing movement of the staging valve will produce movement of carrier 11 and the fuel metering rod will move relative to the fuel circuit inlet, thus resulting in an increase or decrease in the quantity of fuel flowing through the fuel circuit. Therefore, control means 1 independently controls the position of the fuel metering rod relative to the fuel circuit inlet and, thus controls the quantity of fuel flowing through the fuel circuit.

In view of the above, it will be seen that the several objects of the invention are achieved and other advantageous results attained.

As various changes in the above constructions could be made without departing from the scope of the invention, it is intended that all matter contained in the above description or shown in the accompanying drawings shall be interpreted as illustrative and not in a limiting sense.

What is claimed is:

1. In a carburetor for an internal combustion engine, the carburetor comprising a carburetor body having an induction passage through which air is drawn into the engine, a throttle valve positioned in the passage and movable between an open and a closed position to control the quantity of air drawn into the engine, a fuel circuit through which fuel is drawn from a fuel bowl to the induction passage for mixing with air to form an air-fuel mixture combusted in the engine, a fuel metering rod responsive to movement of the throttle valve for varying the quantity of fuel flowing from the fuel bowl through the fuel circuit, the fuel metering rod being vertically movable relative to the fuel circuit inlet, a staging valve positioned in the induction passage and movable between an open and a closed position, the staging valve comprising a disk mounted on a rotatable shaft and functioning as a choke valve during engine cranking and warm-up and as an air valve during other engine operating conditions, the improvement comprising means responsive to opening and closing movements of the staging valve when it functions as an air valve for positioning the fuel metering rod relative to an inlet to the fuel circuit to control the quantity of fuel flowing through the fuel circuit as demand for air by the engine increases or decreases, the control means operating independently of the throttle valve to control the quantity of fuel flow and including a hangar assembly having a rotatable carrier from which the fuel metering rod is suspended, rotation of the carrier moving the fuel metering rod relative to the inlet, the hangar assembly having a stationary arm and the carrier being hingedly attached to one end of the stationary arm, a cam fixedly mounted on the shaft, and a bell crank pivotally mounted to the other end of the stationary arm, the bell crank being in contact with both the cam on the staging valve shaft and the movable carrier from which the fuel metering rod is suspended whereby movement of the staging valve produces rotation of the bell crank and a consequent rotation of the carrier thereby to change the position of the fuel metering rod relative to the fuel circuit inlet.

2. The improvement as set forth in claim 1 wherein the carrier has a rest position in which it is substantially parallel to and above the stationary arm of the hangar assembly and movement of the bell crank by the cam as the staging valve opens rotates the carrier to raise the fuel metering rod with respect to the fuel circuit inlet.

3. The improvement as set forth in claim 2 wherein the control means further includes means biasing the carrier toward its rest position.

4. The improvement as set forth in claim 2 wherein the control means further includes means for adjusting the position of the fuel metering rod relative to the fuel circuit inlet when the carrier is at its rest position.

* * * * *